US005081434A

United States Patent [19]

Sakamoto et al.

[11] Patent Number: 5,081,434

[45] Date of Patent: Jan. 14, 1992

[54] FILTER CONNECTOR

[75] Inventors: Yukio Sakamoto, Fukui; Yoshio Hanato; Iwao Fukutani, both of Takefu, all of Japan

[73] Assignee: Murata Manufacturing Co., Ltd., Nagaokakyo, Japan

[21] Appl. No.: 601,302

[22] Filed: Oct. 22, 1990

[30] Foreign Application Priority Data

Oct. 26, 1989 [JP] Japan ..... 1-125735[U]

[51] Int. Cl.[5] ..... H01R 13/66

[52] U.S. Cl. ..... 333/182; 333/185; 439/620

[58] Field of Search ..... 333/12, 182–185; 439/607–610, 620; 361/399–401; 174/51, 52.1

[56] References Cited

U.S. PATENT DOCUMENTS 4,212,510 7/1980 Ritchie et al. ..... 439/608 X
4,407,552 10/1983 Watanabe et al. ..... 333/182 X
4,729,752 3/1988 Dawson, Jr. et al. ..... 439/620
4,795,991 1/1989 Saito et al. ..... 439/620 X
4,799,901 1/1989 Pirc ..... 333/185 X
4,906,209 3/1990 Tanabe et al. ..... 439/620
4,983,935 1/1991 Mouissie ..... 333/185 X

*Primary Examiner*—Eugene R. LaRoche
*Assistant Examiner*—Seung Ham
*Attorney, Agent, or Firm*—Burns, Doane, Swecker & Mathis

[57] ABSTRACT

A filter connector comprising a housing made of insulating material, an earth plate fitted to the housing, which earth plate has an engaging portion to be engaged with a circuit board, and a signal transmitting pin fitted to the housing, which pin has a filter element electrically connected with the earth plate. The earth plate is connected directly with a ground conductor on the circuit board, and the engaging portion prevents the connector from separating from the circuit board.

4 Claims, 2 Drawing Sheets

FILTER CONNECTOR

BACKGROUND OF THE INVENTION

1. Field of the Invention

The present invention relates to a filter connector, and more specifically to a connector wherein every signal transmitting pin has a through type capacitor for eliminating high frequency noise.

2. Description of Related Art

FIG. 6 shows a conventional filter connector. The filter connector has a housing 20 made of insulating material, signal transmitting pins 21 each of which is provided with a through type capacitor 22, a ground pin 23 and an earth plate 24. The ground pin 23 and the capacitor 22 are electrically connected with the earth plate 24. After the ground pin 23 was fitted to the housing 20, kink processing is carried out toward the lower part of the pin 23 to form a protrusion 23*a*. When the ground pin 23 is inserted into a hole 26 made in a circuit board 25, the protrusion 23*a* is engaged with the hole 26, thereby preventing the connector from moving up and separating from the circuit board 25. The ground pin 23 is connected with a ground conductor on the circuit board 25, and the pins 21 are inserted into holes 27 made in the board 25 and connected with specified signal conductors respectively.

In such a connector, a ground pin is indispensable to earth a through type capacitor. Accordingly, it costs more to produce such a connector, and a produced connector is large because of the ground pin.

SUMMARY OF THE INVENTION

It is therefore an object of the present invention to provide an economy and compact filter connector by eliminating a ground pin.

In order to attain this object, a filter connector according to the present invention comprises an insulating housing, and an earth plate fitted to the housing, which earth plate has engaging means to be engaged with a circuit board. When the filter connector is mounted on a circuit board, the engaging means prevents the connector from separating from the circuit board. The earth plate is connected directly with a ground conductor on the circuit board.

Since the earth plate has the engaging means to be engaged with a circuit board, a ground pin is not necessary any more, and also there is no need to perform kink processing toward the ground pin, which processing has been troublesome. Accordingly, it costs less to produce such a filter connector, and a produced connector is smaller than a conventional connector having a ground pin by the space for the ground pin.

BRIEF DESCRIPTION OF THE DRAWINGS

This and other objects and features of the present invention will become apparent from the following description taken in conjunction with the preferred embodiments thereof with reference to the accompanying drawings, in which.

DETAILED DESCRIPTION OF THE PREFERRED EMBODIMENTS

Exemplary filter connectors embodying the principles and features of the present invention are hereinafter described in reference to the accompanying drawings.

Figure 1:
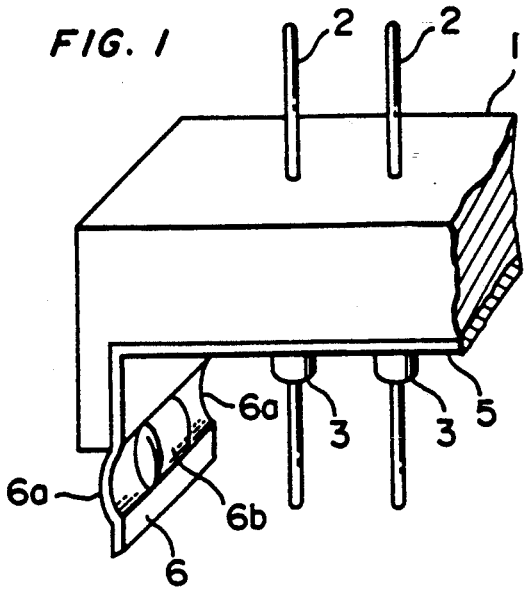
FIG. 1 is a perspective view of a connector according to a first embodiment of the present invention.
Figure 2:
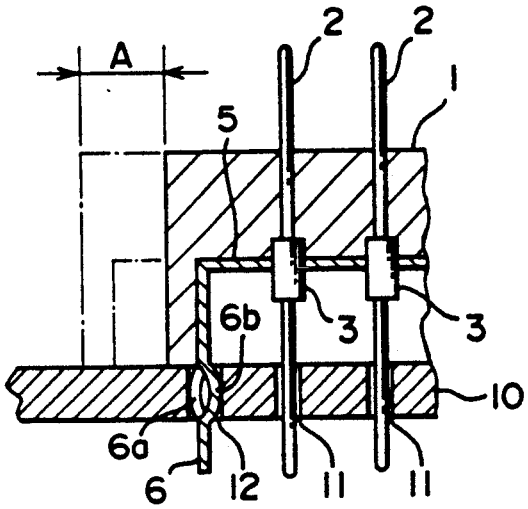
FIG. 2 is a vertical sectional view of the connector according to the first embodiment, showing a state in which the connector is mounted on a circuit board.

First Embodiment: FIGS. 1 and 2

In FIGS. 1 and 2, which show a first embodiment of the present invention, numeral 1 denotes a resin housing for a body of the connector. Numeral 2 denotes a signal transmitting pin, and in this connector, a specified number of signal transmitting pins 2 pierce the housing 1. Every of the signal transmitting pins 2 has a through type capacitor 3. Numeral 5 is an earth plate. The inner surface of the housing 1 is covered with the earth plate 5, and the through type capacitors 3 of the pins 2 are connected with the earth plate 5 by external electrodes of the capacitors 3. The lower end part of the earth plate 5 is stuck out of the housing 1, and protrusions 6*a* and 6*b* are formed on the lower end part in a manner in which the protrusions 6*a* and 6*b* are protruded from the opposite surface.

This connector is mounted on a circuit board 10 by inserting the pins 2 and the lower end part 6 of the earth plate 5 into holes 11 and 12 of the board 10. Because of the protrusions 6*a* and 6*b*, the earth plate 5 is locked in the hole 12, thereby preventing the connector from separating from the circuit board 10. The end part 6 of the earth plate 5 and the pins 2 are electrically connected with a ground conductor and specified signal conductors on the circuit board 10 respectively by soldering or the like.

According to this first embodiment, no ground pin is necessary. As shown in FIG. 2, the connector which has no ground pin is smaller than a conventional connector which has a ground pin by the space A. Also, since the protrusions 6*a* and 6*b* of the earth plate 5 are formed before the assembly of the connector, there is no need to perform kink processing toward the earth plate 5 fitted to the housing 1.

Figure 3:
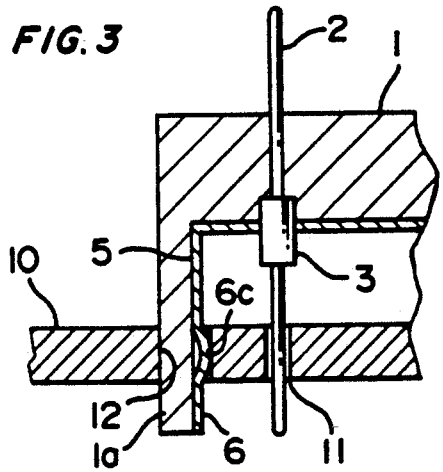
FIG. 3 is a vertical sectional view of a connector according to a second embodiment of the present invention, showing a state in which the connector is mounted on a circuit board.

Second Embodiment: FIG. 3

According to a second embodiment, the housing 1 extends an end 1*a* downward so that the end 1*a* of the housing 1 as well as the end part 6 of the earth plate 5 is inserted into the hole 12 of the circuit board 10. A protrusion 6*c* is formed at the end part 6 of the earth plate 5, and the earth plate 5 is locked in the hole 12 because of the protrusion 6*c*, thereby preventing the connector from separating from the circuit board 10.

The connector according to the second embodiment has the same structure and effect as the connector according to the first embodiment except for the above-described point.

Figure 4:
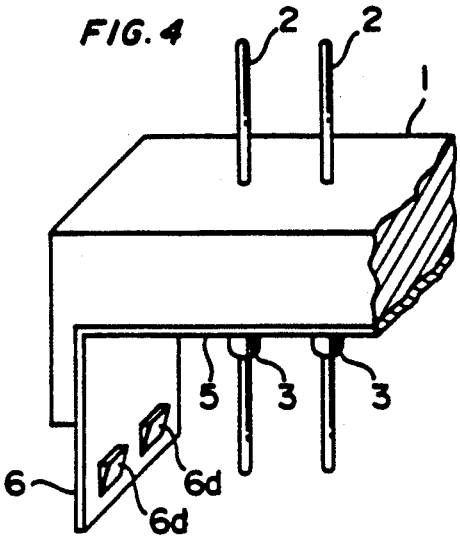
FIG. 4 is a perspective view of a connector according to a third embodiment of the present invention.
Figure 5:
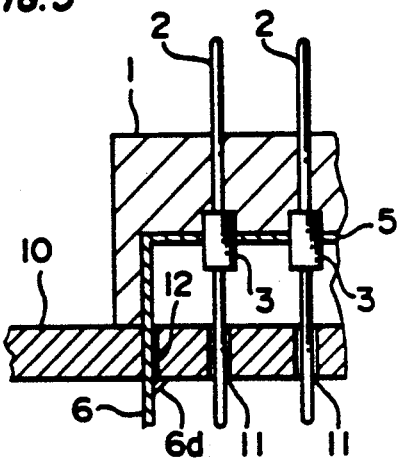
FIG. 5 is a vertical sectional view of the connector according to the third embodiment, showing a state in which the connector is mounted on a circuit board.
Figure 6:
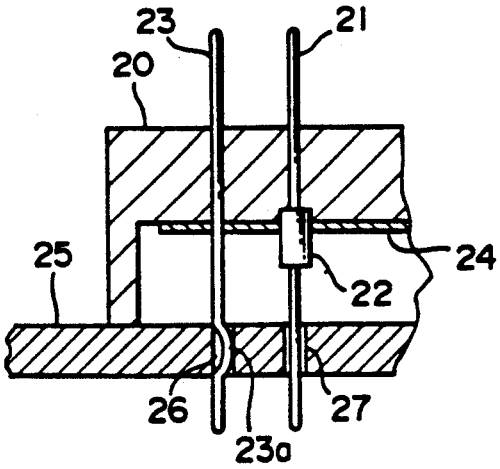
FIG. 6 (PRIOR ART)
FIG. 6 is a vertical sectional view of a conventional connector, showing a state in which the connector is mounted on a circuit board.

Third Embodiment: FIGS. 4 and 5

According to a third embodiment, tabs 6*d* are formed at the end part 6 of the earth plate 5 by projecting processing. When the connector is mounted on the circuit board 10, the end part 6 of the earth plate 5 pierces the board 10 through the hole 12 so that the tabs 6*d* come into contact with the board 10 from below. Thereby, the connector is prevented from separating from the circuit board 10.

The connector according to the third embodiment has the same structure and effect as the connector according to the first embodiment except for the above-described point.

Although the present invention has been described in connection with the preferred embodiments thereof, it is to be noted that various changes and modifications are apparent to those who are skilled in the art. Such changes and modifications are to be understood as included within the scope of the present invention as defined by the appended claims.

What is claimed is:

1. A filter connector for connecting an electronic appliance with a circuit board, said filter connector comprising:

a housing made of insulating material;

an earth plate fitted to the housing, which earth plate has engaging means to be engaged with the circuit board; and a signal transmitting pin fitted to the housing, which pin has a filter element electrically connected with the earth plate.

2. A filter connector as claimed in claim 1, wherein the engaging means includes protrusions formed on the earth plate, which protrusions are protruded from an opposite surface and are to be inserted into a hole of the circuit board.

3. A filter connector as claimed in claim 1, wherein an end part of the housing adheres to the engaging means of the earth plate, which end part of the housing is to be inserted into a hole of the circuit board together with the engaging means.

4. A filter connector as claimed in claim 1, wherein the engaging means includes a tab formed on an end part of the earth plate, which is to be inserted into a hole of the circuit board until the tab is positioned below the circuit board.

* * * * *